US007752822B2

(12) United States Patent
Minelli

(10) Patent No.: US 7,752,822 B2
(45) Date of Patent: Jul. 13, 2010

(54) COMPOSITE FRAMING MEMBER FOR USE IN AN INSULATED PANEL FOR WALK-IN COOLERS AND FREEZERS AND NON-REFRIGERATED ENCLOSURES

(75) Inventor: Fred L. Minelli, Carrollton, TX (US)

(73) Assignee: Kysor Panel Systems, Fort Worth, TX (US)

( * ) Notice: Subject to any disclaimer, the term of this patent is extended or adjusted under 35 U.S.C. 154(b) by 1076 days.

(21) Appl. No.: 11/007,865

(22) Filed: Dec. 9, 2004

(65) Prior Publication Data

US 2005/0120664 A1 Jun. 9, 2005

Related U.S. Application Data

(60) Provisional application No. 60/528,231, filed on Dec. 9, 2003.

(51) Int. Cl.
*E04B 2/08* (2006.01)

(52) U.S. Cl. ..... 52/589.1; 52/578; 52/800.12; 52/586.1; 52/586.2

(58) Field of Classification Search ..... 52/578, 52/586.1, 586.2, 589.1, 309.4, 309.7, 309.16, 52/800.12, 730.5, 731.3, 732.2, 731.1, 720, 52/346, 732

See application file for complete search history.

(56) References Cited

U.S. PATENT DOCUMENTS 2,097,484 A * 11/1937 Winslow ..... 52/578
2,356,309 A * 8/1944 Garbe ..... 52/481.2
2,508,032 A 5/1950 Kennedy
2,776,080 A 1/1957 Hopfield
3,125,192 A * 3/1964 Ramseur ..... 52/582.1
3,378,951 A * 4/1968 Malone, Jr. ..... 49/127
3,509,673 A * 5/1970 Witkosky et al. ..... 52/242
3,638,384 A * 2/1972 Martin ..... 52/592.1
3,774,344 A * 11/1973 Symons ..... 49/504
3,798,861 A * 3/1974 Weiss ..... 52/306
3,950,912 A 4/1976 Lundberg et al.
D262,404 S 12/1981 Bittner
4,597,813 A * 7/1986 Hipkins ..... 156/79
4,752,517 A * 6/1988 Beitel ..... 428/122
4,758,299 A * 7/1988 Burke ..... 156/313
4,949,518 A * 8/1990 Nagel et al. ..... 52/239
5,007,222 A * 4/1991 Raymond ..... 52/586.1
5,014,478 A * 5/1991 Spring ..... 52/281
5,022,205 A * 6/1991 Ford ..... 52/309.16
D330,432 S 10/1992 Weinerman
D346,032 S 4/1994 Colson
5,305,567 A * 4/1994 Wittler ..... 52/238.1
5,315,804 A 5/1994 Attalla (Continued)

*Primary Examiner*—David Dunn
*Assistant Examiner*—Joshua Ihezie
(74) *Attorney, Agent, or Firm*—Ohlandt, Greeley, Ruggiero & Perle, L.L.P.

(57) ABSTRACT

A framing member has a first structural member being made from a first resilient material with the first structural member having a base portion and a first flange arm portion at an end thereof. The first flange arm portion is connected to the base portion and the base portion has a curved notch. The curved notch is adjacent to the first flange arm. The framing member has a second flange extending from the curved notch with a second insulating material contacting a portion of the first flange arm, the base portion, the second flange, and the curved notch. The second insulating material prevents heat transfer through the framing member.

13 Claims, 4 Drawing Sheets

U.S. PATENT DOCUMENTS

| | | | | |
|---|---|---|---|---|
| 5,464,302 | A | 11/1995 | Menchetti | |
| 5,811,035 | A * | 9/1998 | Mockry | 261/111 |
| 5,893,248 | A * | 4/1999 | Beliveau | 52/309.7 |
| 5,975,661 | A * | 11/1999 | Jeziorowski et al. | 312/296 |
| 6,279,278 | B1 * | 8/2001 | Morris et al. | 52/239 |
| 6,381,916 | B1 * | 5/2002 | Maisch et al. | 52/736.1 |
| 6,485,122 | B2 * | 11/2002 | Wolf et al. | 312/406.2 |
| 6,519,911 | B1 | 2/2003 | Sawada | |
| D485,621 | S | 1/2004 | Deel | |
| 6,718,721 | B2 * | 4/2004 | Albany et al. | 52/588.1 |
| 2001/0004825 | A1 | 6/2001 | Menendez | |
| 2002/0095903 | A1 * | 7/2002 | Kawasaki et al. | 52/578 |
| 2003/0205010 | A1 * | 11/2003 | Anglin et al. | 52/238.1 |

* cited by examiner

COMPOSITE FRAMING MEMBER FOR USE IN AN INSULATED PANEL FOR WALK-IN COOLERS AND FREEZERS AND NON-REFRIGERATED ENCLOSURES

CROSS REFERENCE TO RELATED PATENT APPLICATIONS

This patent application claims priority to U.S. Provisional Patent Application Ser. No. 60/528,231 filed on Dec. 9, 2003, which is herein incorporated by reference in its entirety.

BACKGROUND OF THE INVENTION

This invention relates to composite framing members for insulated panels. More particularly, the present invention relates to framing members that are made of two or more materials that provide for increased strength, a uniform amount of insulation, and ease of assembly and a reduced amount of heat transfer through the framing member.

DESCRIPTION OF THE RELATED ART

Metal framing members are known in the art. One such metal framing member is U.S. Pat. No. 5,315,804 to Attalla. Attalla discloses a framing member that has stiffening sections to ensure that a lighter or cheaper gauge of galvanized steel can be used for manufacture of the framing member. The framing member is a rectangular member that manufactured in a "C" shape. The "C" shaped member has an interior surface and an exterior surface opposite the interior surface. The interior surface of the "C" shaped member has a number of stiffening members thereon. The stiffening members are a number of "U" shaped protrusions in the otherwise rectangular smooth cross section of the interior surface. The stiffening members provide structural integrity so a manufacture may use a thinner or cheaper gauge of galvanized steel for a thirty percent cost savings during manufacture of the framing members.

A problem with such a framing member is that although the stiffening member provides structural integrity so a manufacturer may use a thinner gauge of galvanized steel, it is difficult to introduce insulation in such a rectangular or "C" shaped configuration. The "C" shaped configuration has a deep interior. Thus, the deeper interior has too large of a filling space to introduce an expensive insulation. This would increase costs associated with introducing insulation therein. Moreover, the spaces attributed to the stiffening members would causes difficulty in the fluid flow of a second insulating material therein. These empty filling spaces would cause spaces in filled insulating material and thus poor construction and a weak composite.

Another framing member is disclosed in U.S. Pat. No. 5,893,248 to Beliveau. Beliveau discloses an insulating panel for a ceiling structure. The insulating panel has a rigid body with a top surface and a bottom surface and a number of framing members. The number of framing members are each in the insulating panel. The number of framing members are each disposed flush with the bottom surface of the insulating panel. Each of the framing members has a body with a "U" shaped cross section. Each of the framing members has a first arm and a second arm with angled ends extending from the body for anchoring the framing member's body into the insulating panel.

Beliveau discloses that the body further has an elongated protrusion or rectangular slot in a centermost portion of the "U" shaped cross section. The slot is for receiving a fastener therein such as the head of a screw. An insulating material is disposed on a top side of the framing member, and the insulating panel is connected to another ceiling joist as is known in the art for home construction. The insulating capacity of Beliveau is small and thus not effective for insulating refrigeration application, because the insulating capacity is limited by a narrower "U" shaped cross section and overall height of the framing member. Moreover, the insulating material such as foam has difficultly flowing therein and overall being introduced between the first arm, the second arm, the angled ends, and the slot.

Another framing member is disclosed for sound proofing a wall in U.S. Pat. No. 3,950,912 to Lundberg. Lundberg discloses a skeleton frame and an insulating member being disposed in the spaces between the skeleton frame and a surface covering. The skeleton frame has a body with a "C" shaped cross section with a first flange arm and a second flange arm extending from a base member. The base member has a series of notches therein. The skeleton frame also has an inner flange. The inner flange is between both the first flange arm and the second flange arm. The inner flange has a height that is lower than both the first flange arm and the second flange arm. The inner flange also has an narrow top side slot. The top side slot is disposed through a top of the inner flange.

A cam rolling grinding wheel is traversed over the inner flange to produce the narrow top side slot. An insulating material is disposed over the skeleton frame. However, Lundberg discloses that a number of empty spaces result after the insulation is introduced because the insulating material can not (and does not) fill out all of the empty spaces of the skeleton frame. Lunberg discloses that up to three fifths of a height of the skeleton frame will remain unfilled. Moreover, some insulating materials due to the fluid flow properties of the insulating material cannot further traverse (at all) into any narrow top side slot, of the inner flange. Although, this insulating arrangement may be suitable for some applications such as sound insulation, other refrigeration applications require a greater or more fuller and uniform amount of insulation due to quick heat transfer on or at the non-insulated portions of the framing member.

On occasion, installers and/or manufacturers where labor is especially costly do not have the time during production to summon another individual to inspect, add, subtract or replace insulation at predetermined parts of the framing member. Often it is difficult because at a first time, the insulation will appear to be at a first height, then at a second time once, the insulation settles therein. Once settling occurs will be holes, or spaces in the aggregated insulation and the insulation will be at a second or lower height in some areas. Such labor is costly, and in order to facilitate finishing the job the installer will undergo the risk of a simple visual inspection and an uneven application of insulation which is very disfavorable especially in the instance of refrigeration equipment. Lack of insulation can result in a loss profits and increased energy costs that are attributed to long term heat transfer in under insulated framing members.

Accordingly, there is a need for an framing member that eliminates one or more of the aforementioned drawbacks and deficiencies of the prior art.

According to a first aspect of the present invention, there is a need in the art for a framing member that has a fire retardant skin that at least partially surrounds a core of thermally insulating material.

There is a need in the art for a framing member that has one or more series of legs being provided within the skin to enhance the structural strength of the frame member.

There is a further need in the art for a framing member with an improved geometry that allows an insulating material to be introduced quickly, and effectively in a filling space in the framing member with high productivity.

There is still another need in the art for a framing member with a strong structural integrity with made from two or more materials.

There is still another need in the art for a framing member with a strong structural integrity with made from two or more materials with one of the materials being an insulating material suitable for insulation in a "walk in" refrigerator unit or "walk in" freezer unit.

SUMMARY OF THE INVENTION

The framing member according to one embodiment of the present invention has a first structural member made from a first resilient material. The first structural member has a base portion and a first flange arm portion at an end thereof. The first flange arm portion is connected to the base portion. The base portion has a curved notch and the curved notch is adjacent to the first flange arm. The framing member also has a second flange extending from the curved notch and a second insulating material contacting a portion of the first flange arm, the base portion, the second flange, and the curved notch. The second insulating material prevents heat transfer through the framing member.

In an alternate embodiment of the framing member of the present invention, the framing member has a third flange arm portion. The third flange arm portion is connected to the base portion at a second end with the third flange arm portion being arranged so that said curved notch is disposed between the third flange arm portion and the first flange arm portion.

In another alternate embodiment of the framing member of the present invention, the second flange is an inner flange being between the first flange arm portion and the third flange arm portion.

In still another embodiment of the present invention, the framing member can have the second flange being a number of inner flanges. The inner flanges are in one embodiment between first flange arm portion and the third flange arm portion.

In still another embodiment of the framing member of the present invention, the framing member could potentially have the second inner flange extending from the curved notch with the curved notch having a shape selected from the group consisting of a concave shape, a convex shape, a triangular shape, a recess, a slot, and any combinations thereof.

In alternate embodiments, the framing member can have the second inner flange with a greater height than the first flange arm portion and the third flange arm portion.

According to another embodiment of the present invention, the framing member has a first structural member made from a first resilient material with the first structural member having a base portion, a first flange arm portion, and a second flange arm portion. The first flange arm portion and the second flange arm portion are connected to the base portion. The base portion has a curved notch with the curved notch being between the first flange arm portion, and the second flange arm portion. The framing member also has a first inner flange having a height greater than both the first flange arm portion and the second flange arm portion with the first inner flange connected to the base portion and the first inner flange extending opposite the base portion from the curved notch.

The framing member in this embodiment also has a second inner flange with the height and the second inner flange extending opposite the base portion from the curved notch with the second inner flange substantially parallel to the first inner flange. A first space is defined between the first flange arm portion and the first inner flange and a second space is defined between the first inner flange and the second inner flange. A third space is defined between the second inner flange and the second flange arm portion. The framing member also has a second insulating material disposed in the first through third spaces with the second insulating material for insulating the framing member.

In the various embodiments, the framing member may alternatively or additionally have the curved notch being concave relative to the base portion.

In alternate embodiments, the framing member may have the curved notch being convex relative to said base portion, and the first inner flange and the second inner flange each having a height less than either the first flange arm portion and the second flange arm portion.

According to another alternative embodiment, the framing member has a first structural member made from a first resilient material with the first structural member having a base portion, a first flange arm, and a second flange arm. The first flange arm and the second flange arm are connected to the base portion. The said base portion has a slot therein. The slot has a depth and the slot is between the first flange arm, and the second flange arm. The framing member also has a pair of inner flanges connected to the base portion with the pair of inner flanges extending opposite the base portion from a position that bears a relationship to the slot. A number of filling spaces are created. A second insulating material is disposed in the filling spaces and the second insulating material prevents heat transfer through the framing member.

According to still another further embodiment of the present invention of the framing member, the framing member comprises a base portion with a recessed portion, a first flange arm portion connected at a first end of the base portion, and a second flange arm portion connected at a second end. The second end is opposite the first end. The framing member also has an inner flange connected to the base portion at the recessed portion. The inner flange, the first flange arm portion, and the second flange arm portion extend to and do not exceed a predetermined line of demarcation. The inner flange, the first flange arm portion, and the second flange arm portion are made from an injection molded polymer.

In the various embodiments of the framing member of the present invention, the recessed portion may have a shape selected from the group consisting of a convex shape, a concave shape, a flat shape, an irregular shape, a "V" shape and any combinations thereof.

The method of making the framing member according to one embodiment of the present invention has the step of providing a skin and a number of legs in a desired shape. The method further has the step of introducing a thermally insulating material. Preferably, the material is a thermoset plastic that is reaction injected molded. The liquid material is poured or flowed into the skin. The legs are spaced apart to enhance the flow of the plastic material to substantially all of the interior space of the skin.

DESCRIPTION OF THE DRAWINGS

Other and further objects, advantages and features of the present invention will be understood by reference to the following specification in conjunction with the accompanying drawings, in which like reference characters denote like elements of structure and.

DETAILED DESCRIPTION OF THE INVENTION

Figure 1:
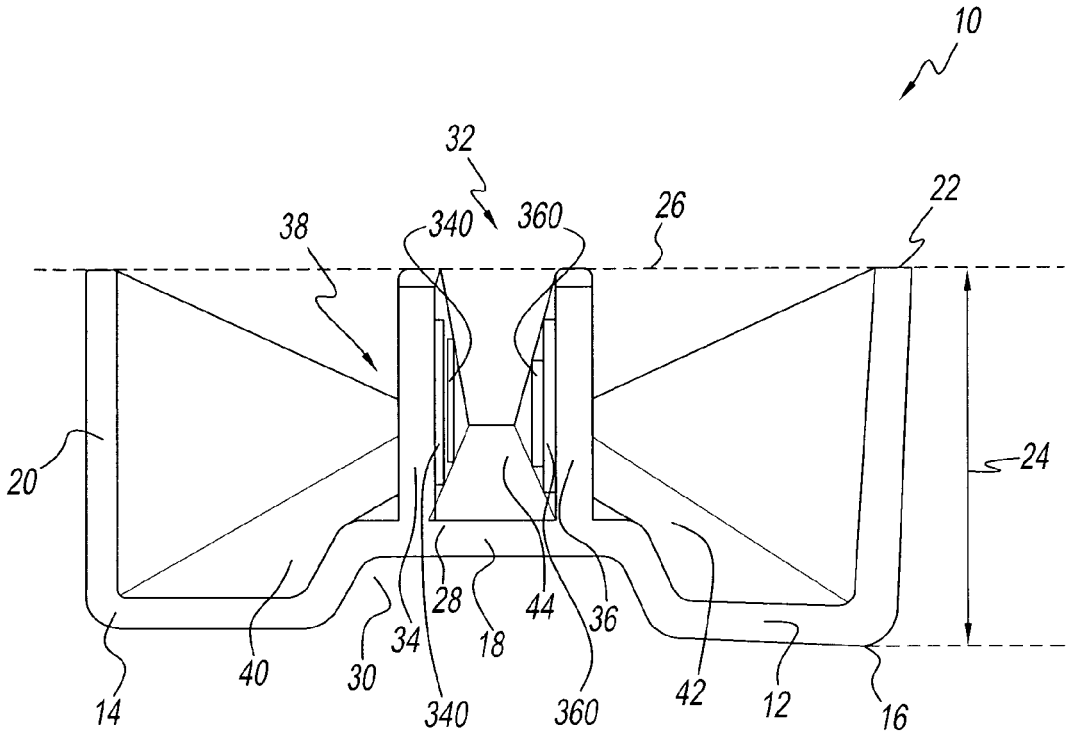
FIG. 1 is an end view with isometric portions of a first embodiment of a framing member of the present invention.

Referring to FIG. 1, there is shown a framing member 10 of the present invention. The framing member 10 most preferably is used in refrigeration units, freezer units, cooling devices or any other appliance, cabinet, or room for storing food, liquids, health products, perishable items or other substances at a low temperature as is known in the art. Alternatively, the framing member 10 is used in any other type of commercial or residential building or static or dynamic construction known in the art such as in a ceiling, a wall, a floor, a foundation, an automobile, a vessel, an aircraft, a truss, a joist, or any other type structure using insulation known in the art.

The framing member 10 preferably is made from two or more materials and as shown may have any length known in the art suitable for the desired application. The first material is a resilient durable material and the second material is an insulating material. The framing member 10 shown in FIG. 1 is shown at an end looking down a length of the framing member. The framing member 10 preferably has a base portion 12. The base portion 12 shown in cross section at an end of the framing member 10 and extends horizontally a predetermined amount as shown. In one non-limiting embodiment of the present invention, the base portion may have any width in a range of 1⅞ inches through 6.0 inches. The base portion 12 preferably has a first outermost end 14 and a second opposite outermost end 16 and a centermost portion 18 being between the first outermost end and the second outermost end.

The framing member 10 preferably further has a first outer flange 20. The first outer flange 20 extends upwardly from the first outermost end 14 in a substantially perpendicular fashion and extends along the length of the framing member 10. Alternatively, the first outer flange 20 may be disposed extending opposite from the base portion 12 at a predetermined angle for a desired application.

The framing member 10 further has a second outer flange 22. The second outer flange 22 extends upwardly from the second outermost end 16 in a substantially perpendicular fashion and with the first outer flange 20 forms a "U" shaped skin or structure. Again, alternatively like the first outer flange 20, the second outer flange 22 may be disposed extending opposite from the base portion 12 perpendicularly or at the predetermined angle. The first outer flange 20 and the second outer flange 22 preferably have the same height 24 or in one non-limiting embodiment of the present invention are about one and one half inches. However, each may have any height suitable for the application. Each of the first outer flange 20 and the second outer flange 22 terminate at predetermined line of demarcation as indicated by reference numeral 26. In one non-limiting embodiment of the present invention, the line of demarcation is about one and one half inches from a bottom end of the base portion 12.

The framing member 10 further has a raised portion 28 on the base portion 12. As shown in FIG. 1, the raised portion 28 is shown as an elevated and concave feature relative to the base portion 12 at the centermost portion 18 of the base portion. The raised portion 28 preferably and bulges outward such as an exterior surface of a sphere, and may be formed by a punching or molding operation. The raised portion 28 preferably forms an angle with the base portion 12 of about twenty six degrees. Disposed on an opposite side thereof, the framing member 10 has a notch 30 that is on the base portion 12 of the framing member opposite the raised portion 28. The notch 30 will be revealed on an exterior surface of the framing member 10, and along the length or a portion of the length of the framing member 10. The notch 30 preferably assists with mating the framing member 10 with another structure.

The framing member 10 also has a number of inner flanges 32. In a preferred embodiment of the present invention, the framing member 10 has a first inner flange 34 and a second inner flange 36. Most preferably, the first inner flange 34 is substantially parallel to both the second inner flange 36, and each of the first outer flange 20, and the second outer flange 22. The first inner flange 34 is preferably spaced apart from the second inner flange 36 by one half of an inch. The first inner flange 34 also has about the same height as the second inner flange 36. Each of the first and the second inner flanges 34, 36 extends opposite from the base portion 12. Each further extends from the raised portion 28 of the centermost portion 18 of the base portion 12. A significant aspect of the present invention is that both the first inner flange 34 and the second inner flange 36 each have a height that does not exceed the first line of demarcation 26. Preferably, the first inner flange 34 and the second inner flange 36 preferably each terminate at the predetermined line of demarcation as indicated by reference numeral 26. The first inner flange 34 and the second inner flange 36 preferably extend along the length of the framing member 10 into the page and may be solid members, or discontinuous and segmented members 340, 360 isometrically disposed along the length of the framing member 10.

The framing member 10 thus provides for a plurality of filling spaces 38 for the productive introduction and filling of the second material into the framing member. Preferably, the second material is a suitable insulation material, however alternatively, the second material may be any other composite related material known in the art for imparting one or more properties such as strength or fire proofing to the framing member 10. The filling spaces 38 of the framing member 10 are preferably filled to the line of demarcation 26 with a thermally insulating material. For example, thermally insulating material may be polyurethane or other thermally insulating material known in the art. Preferably, thermally insulating material is a liquid that can be poured or flowed and reaction molded into the filling spaces 38 of the framing member 10. One unexpected advantage of the present invention is it has been found that the framing member 10 and the geometry of the filling spaces 38 enhance the flow or migration of the liquid plastic to fill substantially all of the filling spaces therein.

In the embodiment shown, the framing member 10 preferably has a first filling space 40, a second filling space 42, and a middle filling space 44. The first filling space 40 in one non-limiting embodiment is about 1.4375 inches in width. The second filling space 42 in one non-limiting embodiment is also about 1.4375 inches in width. The middle filling space 44 in one non-limiting embodiment is one half of an inch in width. The middle filling space 44 may alternatively be used as a channel for which to mate with a second mating member (not shown) or another structure such as a refrigeration panel, wall or another structure. As can be understood by the drawings, each of the filling spaces 38 is advantageous over the prior art and sufficiently large relative to the prior art to fill with the second material without adding additional pressure, or increasing costs associate with a time consuming inspection of whether any narrow channel has been filled with insulation. Most preferably, the filling spaces 38 are suitable such that the second material will be filled and terminate at the predetermined line of demarcation as indicated by reference numeral 26 for a strong, resilient, and insulated composite framing member 10.

The framing member 10 of the present invention preferably is made as a fire retardant material that has a predetermined cross-sectional shape, which is of any desired shape. For example, one or each of the base portion 12, the first outer flange 14, the second outer flange 16, and the number of inner flanges 32 may be constructed of TELENE® reaction injected molded polymer available from Cymetech of Huntsville, Ala. Alternatively, the one or each of the base portion 12, the first outer flange 14, the second outer flange 16, and the number of inner flanges 32 may be made from a composite, a galvanized steel, a metal, an aluminum, a fire retardant wood, a thermoplastic, a thermoset, a polymer, or any other resilient material known in the art.

Figure 2:
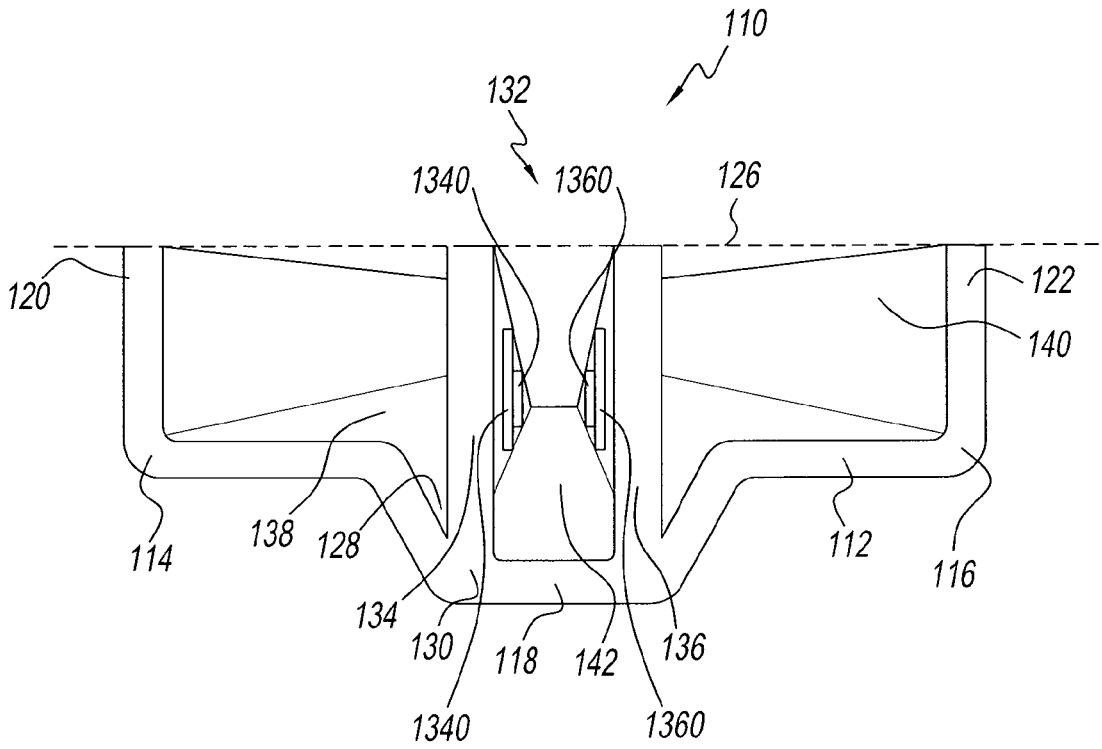
FIG. 2 is an end view with isometric portions of a first embodiment of a framing member of the present invention.

Referring now to FIG. 2, there is shown another end view of another second embodiment of the framing member generally represented as reference numeral 110 for the sake of clarity. The framing member 110 preferably is also made from two or more materials and like the embodiment of FIG. 1 may have any length known in the art suitable for the desired application.

The framing member 110 preferably has a base portion 112 with a first outermost end 114 and a second opposite outermost end 116 and a centermost portion 118. The framing member 110 of this embodiment further has a recessed portion 128. The recessed portion 128 preferably forms a convex feature like the interior of a sphere with the base portion 112 at the centermost portion 118. The recessed portion 128 commences at about one inch from an end of the framing member 110 and forms an angle of about 26.57 degrees with a perpendicular axis intersecting the base portion 112. A bulged portion 130 of the framing member 110 extends outward opposite the recessed portion 128 and has a width of about seven eighths of one inch.

The framing member 110 of FIG. 2 further has a third outer flange 120 that extends substantially perpendicular from the first outermost end 114 and further has a fourth outer flange 122 that extends substantially perpendicular from the second outermost end 116. The third outer flange 120 and the fourth outer flange 122 both have a complementary height that is about the same and is about one inch. Each of the outer flange 120 and the fourth outer flange 122 have a height that does not exceed a line of demarcation represented by reference line numeral 126. The outer flange 120 and the fourth outer flange 122 are in one non-limiting embodiment about three and one half inches away from one another.

The framing member further has a number of inner flanges 132 that extend from the recessed portion 130 of the base portion 112. The framing member 110 may have two or more inner flanges and preferably has a third inner flange 134 and a fourth inner flange 136. As in FIG. 1, third inner flange 134 and fourth inner flange 136 preferably extend along the length of framing member 110 into the page and may be solid members, or discontinuous and segmented members 1340, 1360 disposed along the length of framing member 110. Each of the third inner flange 134 and the fourth inner flange 136 provide strength and extends from the recessed portion 128 of the framing member 110. Each of the third inner flange 134 and the fourth inner flange 136 has a height that does not exceed the line of demarcation 126. One or all of the base portion 112, the first outer flange 114, the second outer flange 116, and the number of inner flanges 132 may be constructed of TELENE® reaction injected molded polymer.

Alternatively, the one or each of the base portion 112, the first outer flange 114, the second outer flange 116, and the number of inner flanges 132 may be alternatively made from a composite, a galvanized steel, a metal, an aluminum, a fire retardant wood, a thermoplastic, a thermoset, a polymer, or any other resilient material known in the art.

In this manner, the framing member 110 has a fourth filling space 138, a fifth filling space 140, and a sixth middle filling space 142. The fourth filling space 138 in one non-limiting embodiment has a width of about 1.25 inches. The fifth filling space 140 in one non-limiting embodiment has a width of about 1.25 inches and a sixth middle filling space 142 has a width of about ⅞ inches, however it may have any width in the art. The second insulating material like the embodiment shown in FIG. 1 is preferably filled in one or all of the fourth filling space 138, the fifth filling space 140, and the sixth middle filling space 142. The sixth middle filling space 142 may be alternatively not be filled with insulation and instead be used to connect or otherwise mate with another or mating member (not shown) of another structure for example of an insulated wall or refrigeration unit.

Figure 3:
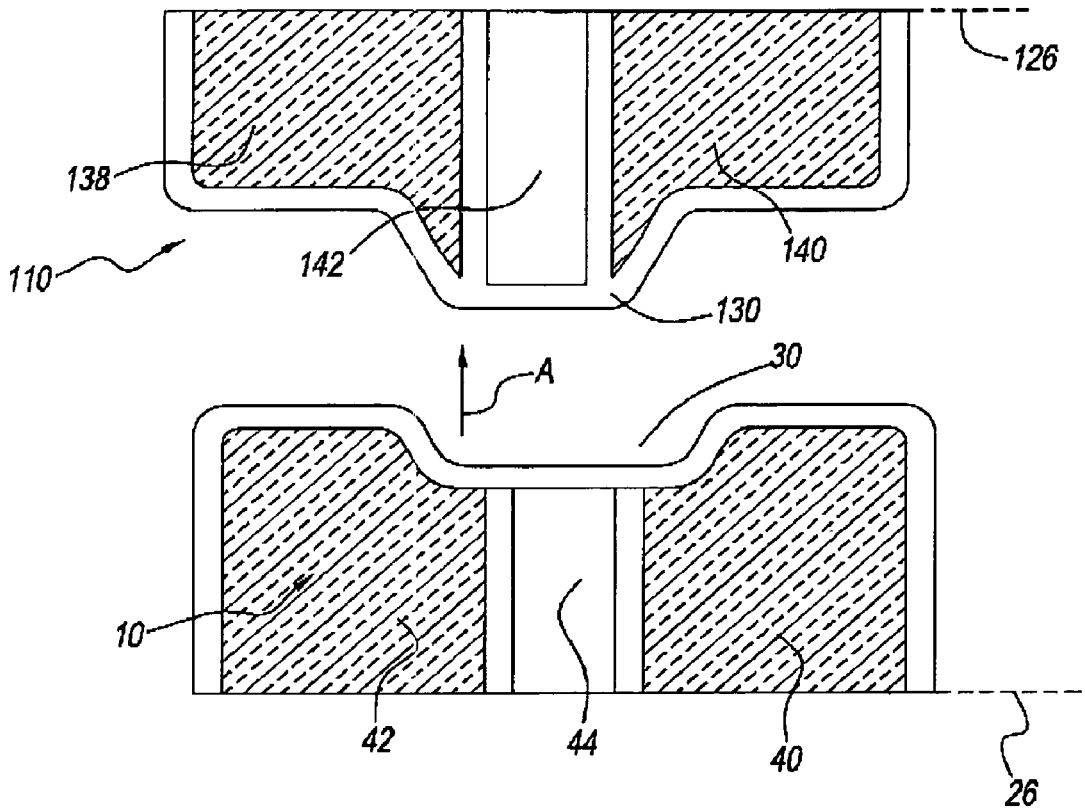
FIG. 3 is another end view of the framing member of FIG. 1 mating with the framing member of FIG. 2 with the framing members being made of a first material and with the framing materials being filled with an insulating second material.

Referring now to FIG. 3, there is shown framing member 10 (in an inverted position) being connected to framing member 110. In one embodiment, the bulged portion 130 of the framing member 110 mates and connects with the notch 30 on the exterior surface of the framing member 10 as shown by reference arrow A. Moreover, the insulation or the second material is disposed in the first filling space 40, the second filling space 42, the fourth filling space 138, and the fifth filling space 140, and optionally in the middle filling space 44, and the sixth middle filling space 142 as shown.

Figure 4:
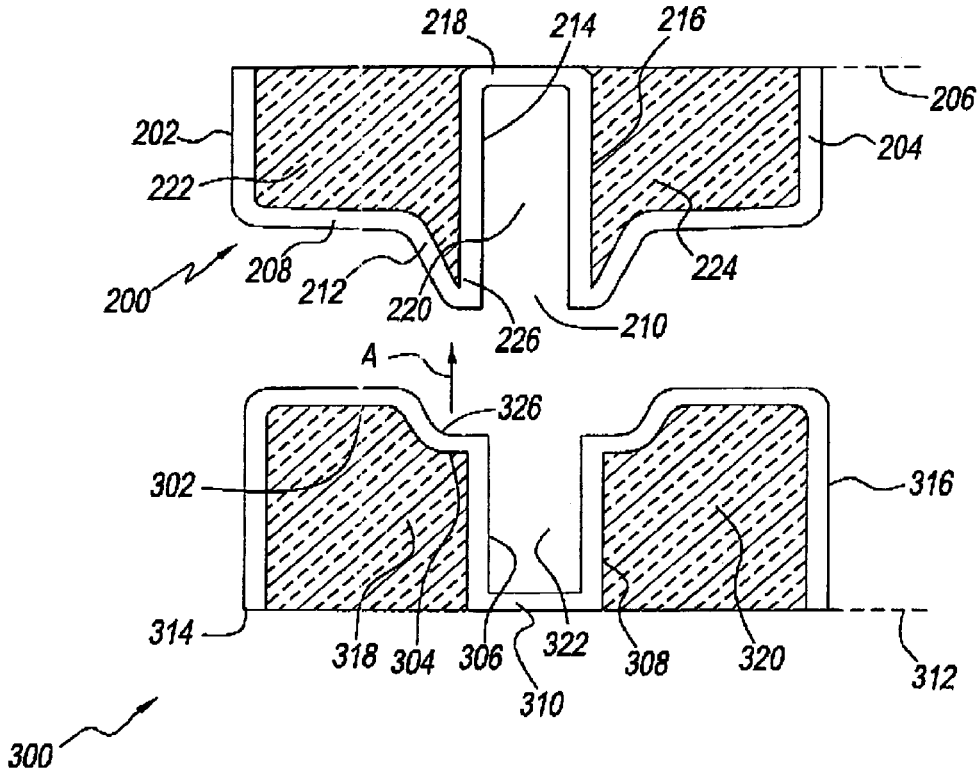
FIG. 4 is an end view of another embodiment of another framing member mating with still a further embodiment of another framing member with each of the framing members being made of a first material and with the first and second framing members being filled with an insulating second material.

Referring to FIG. 4, there is shown another embodiment of the framing member generally represented by reference numeral 200 being shown in an inverted position. The framing member 200 preferably has a first outer flange 202 and a second outer flange 204. The first outer flange 202 and the second outer flange 204 preferably are about the same height, and each may have any suitable height known in the art. The first outer flange 202 and the second outer flange 204 each terminate at a predetermined line of demarcation 206.

The framing member 200 has a base portion 208. The base portion 208 has an aperture 210 therein. The base portion 208 also has a recessed portion 212 in a centermost portion of a base portion. The recessed portion 212 is preferably a concave feature in the base portion 208. The framing member 200 also has a first inner flange 214 and a second inner flange 216 that extend from the recessed portion 212. In this embodiment, the first inner flange 214 and the second inner flange 216 are further connected to one another at a location at or on the line of demarcation 206 by an intermediate inner flange 218. The intermediate inner flange 218 extends along a space 220 being between the first inner flange 214 and the second inner flange 216. The intermediate inner flange 218 is a resilient member made from the same or a different material than that of the first inner flange 214 and the second inner flange 216. The intermediate inner flange 218 further is disposed laterally at the line of demarcation 206 to connect the inner flanges 214, 216. Preferably, the intermediate inner flange 218 has a flat topside that does not exceed the line of demarcation 206.

The framing member 200 further has a first filling space 222 and a second filling space 224 and the intermediate mating space 220. The framing member further has a protruding portion 226 that extends opposite the recessed portion 212. The protruding portion 226 may be an arm, or a bulbous feature in the exterior of the framing member 200 to mate with another complementary sized member. The intermediate mating space 220 extends through and communicates with the aperture 210 through the protruding portion 226. The protruding portion 226 is preferably for mating with another second member. The framing member 200 may have another rectangular shaped beam, or other structural member inserted through the aperture 210 and rested in the intermediate mating space 220. Preferably, a suitable insulating material is disposed in the first filling space 222 and the second filling space 224. The insulating material preferably is introduced and fills both the first filling space 222 and the second filling space 224 to the line of demarcation 206. As discussed above in one non-limiting embodiment, the insulating material may be a urethane insulation.

Disposed below the framing member 200 is another embodiment of the framing member generally represented as reference numeral 300. The second framing member 300 shown in FIG. 4 preferably mates with the framing member 200. The second framing member 200 has a base portion 302 with an elevated portion 304. Extending from first the elevated portion 304 is a first inner flange 306 and a second inner flange 308. The second framing member 300 further has a intermediate flange member 310 connecting the first inner flange 306 and the second inner flange 308 at a line of demarcation 312. The second framing member 300 further has a first outer flange 314 and a second outer flange 316. Each of the first outer flange 314 and the second outer flange 316 has a height that does not exceed the line of demarcation 312. A first filling space 318 is formed between the first outer flange 314 and the first inner flange 306. A second filling space 320 is formed between the second outer flange 316 and the second inner flange 308. The suitable insulating material is disposed in the first filling space 318 and the second filling space 320 to the line of demarcation 312 to form a composite structure as shown.

The second framing member 300 on an exterior side of the base portion 302 opposite the elevated portion 304 has a corresponding notch 326. The corresponding notch 326 has complementary dimensions to the protruding member 226 of the framing member 220. The notch 326 further communicates with an intermediate slot 322 for receipt of the structural member therein such as a beam. The intermediate slot 322 facilitates fastening the second framing member 300 to another structure. The corresponding notch 326 of the second framing member 300 preferably engages with the protruding member 226 of the framing member 200 as indicated by reference arrow A.

It should be understood that the foregoing description is only illustrative of the present invention. Various alternatives and modifications can be devised by those skilled in the art without departing from the invention. Accordingly, the present invention is intended to embrace all such alternatives, modifications and variances. The preferred embodiments described with reference to the attached drawing figures are presented only to demonstrate certain examples of the invention. Other elements, steps, methods and techniques that are insubstantially different from those described above and/or in the appended claims are also intended to be within the scope of the invention.

What is claimed is:

1. A framing member comprising:

a non-metal first structural member made from a first resilient material, said first structural member having a base portion that has an upper surface and a lower surface, said base portion being connected to a first flange arm portion that extends upwardly from said upper surface of said base portion at an end of said base portion, said base portion having an upwardly formed, downwardly facing curved notch, said curved notch being upwardly formed by said lower surface of said base portion, by and at the junction of an inwardly extending and upwardly angled panel portion of said base portion, and a concave horizontal central panel portion of said base portion, said concave central panel portion being elevated relative to said end of said base portion; and said inwardly extending and upwardly angled panel portion and said curved notch merging directly into and being in direct communication with said concave elevated central panel portion of said base portion, a second flange being connected to and extending upwardly from said upper surface of said elevated central panel portion of said base portion, and a second insulating material contacting a portion of said first flange arm, said base portion, said second flange, and said curved notch, wherein said second insulating material prevents heat transfer through the framing member.

2. The framing member of claim 1, further comprising a third flange arm portion being connected to said base portion at a second end, said third flange arm portion being arranged so that said curved notch is disposed between said third flange arm portion and said first flange arm portion.

3. The framing member of claim 2, wherein said second flange is an inner flange being between said first flange arm portion and said third flange arm portion.

4. The framing member of claim 2, wherein said second flange is a plurality of inner flanges being between said first flange arm portion and said third flange arm portion.

5. The framing member of claim 3, wherein said second inner flange extends from said curved notch, said curved notch having a shape selected from the group consisting of a concave shape, a convex shape, a triangular shape, a recess, a slot, and any combinations thereof.

6. A framing member comprising:

a first non-metal structural member made from a first resilient material, said first structural member having a base portion that has an upper surface and opposed ends, a first flange arm, a second flange arm, a pair of inner flanges, and a recessed convex central panel, said first and second flange arms being connected to and extending upwardly from said upper surface of said opposed ends of said base portion, and said pair of inner flanges being connected to and extending upwardly from said upper surface of said recessed convex central panel, said base portion having outer end portions that extend inwardly from said opposed ends toward said inner flanges and merge directly into inwardly and downwardly extending angular panel portions that in turn merge directly into a central panel portion, said central panel portion being recessed below the plane of said outer end portion of said base portion, said base portion and said pair of inner flanges forming a slot, said slot facing upwardly and extending in a downward direction, said slot being defined by the upper surface of said angular panel portion and by the surface of the base of the inner flange that is adjacent said upper surface of said angular panel portion and that is connected to said recessed convex central panel portion, said slot being between said first flange arm and said second flange arm and having a depth that renders the top of said first flange arm and of said second flange arm to be substantially the same height as the height of the tops of said pair of inner flanges, and said pair of inner flanges extending from said recessed central panel portion in a direction opposite to that of said recessed central panel portion, wherein a plurality of filling spaces are created, and wherein a second insulating material is disposed in said plurality of filling spaces, said second insulating material preventing heat transfer through the framing member.

7. The framing member of claim 6, further comprising a second structural member for mating with said first structural member, said second structural member being different from said first structural member, and having a second base portion with an inwardly extending upwardly angled wall and an elevated concave horizontal central panel portion, said upwardly angled wall and said concave horizontal central panel portion being dimensioned to mate with said recessed convex central panel portion when said first structural member is inverted and said horizontal and said recessed central panel portions face and are mated to each other.

8. The framing member of claim 7, wherein said second structural member comprises a second base portion, a third flange arm, and a fourth flange arm, said third flange arm and said fourth flange arm being connected to said second base portion, wherein said second base portion has an elevated portion thereon, said elevated portion having an upper surface and a height, said elevated portion being between said third flange arm, and said fourth flange arm.

9. The framing member of claim 8, wherein said second structural member further comprises a pair of second inner flanges connected to and extending upwardly from said upper surface of said elevated portion.

10. The framing member of any one of claim 1 or 6, wherein all or a portion or portions of said framing member is or are made from a polymer that can be injection molded.

11. A framing member comprising:

a base portion having an upwardly and inwardly angled portion that communicates and merges directly with a raised centermost portion of said base portion, said raised centermost portion having an upper surface;

a first flange arm portion extending upwardly from a first end of said base portion;

a second flange arm portion extending upwardly from a second end being opposite of said first end; and an inner flange having a base extending upwardly from said base portion at said upper surface of said raised centermost portion, wherein said inner flange, said first flange arm portion, and said second flange arm portion extend upwardly to and do not exceed a predetermined line of demarcation, and wherein said inner flange, said first flange arm portion, and said second flange arm portion are made from a polymer that can be injection molded.

12. The framing member of claim 11, wherein there is included a second insulating material that is in contact with said base portion, said first flange arm portion, said second flange arm portion and said inner flange portion, said insulation being for preventing heat transfer through the framing member.

13. A framing member according to claim 11, comprising:

a base portion having an upwardly and inwardly angled portion that communicates and merges with a raised centermost portion of said base portion, said raised centermost portion having an upper surface;

a first flange arm portion extending upwardly from a first end of said base portion;

a second flange arm portion extending upwardly from a second end being opposite of said first end; and a first inner flange and a second inner flange, each of said inner flanges having a base extending upwardly from said base portion at said upper surface of said raised centermost portion, wherein said inner flanges, said first flange arm portion, and said second flange arm portion extend upwardly to and do not exceed a predetermined line of demarcation, and wherein said inner flanges, said first flange arm portion, and said second flange arm portion are made from a polymer that can be injection molded.

* * * * *